United States Patent [19]

Watanabe et al.

[11] Patent Number: 4,661,387

[45] Date of Patent: Apr. 28, 1987

[54] STEEL MATERIALS FOR USE WITH PRESTRESSED CONCRETE

[75] Inventors: Kanji Watanabe; Mikio Mizoe, both of Hyogo, Japan

[73] Assignee: Sumitomo Electric Industries, Ltd., Osaka, Japan

[21] Appl. No.: 681,774

[22] Filed: Dec. 14, 1984

[30] Foreign Application Priority Data

Dec. 16, 1983 [JP] Japan ..... 58-194473[U]

[51] Int. Cl.[4] ..... E04C 5/01; D07B 1/16

[52] U.S. Cl. ..... 428/36; 52/230; 52/722; 57/217; 57/223; 156/79; 428/308.4; 428/336; 428/375; 428/379; 428/383

[58] Field of Search ..... 428/379, 375, 336, 338, 428/383, 308.4, 36; 156/84, 85, 86, 77, 78, 79; 57/217, 221, 223; 264/228; 174/DIG. 8; 52/722, 735, 230

[56] References Cited

U.S. PATENT DOCUMENTS

| | | | |
|---|---|---|---|
| 2,677,957 | 5/1954 | Upson | 52/230 |
| 3,060,640 | 10/1962 | Harris | 52/230 |
| 3,212,222 | 10/1965 | Wittfoht | 52/230 |
| 3,579,931 | 5/1971 | Lang | 52/230 |
| 3,681,911 | 8/1972 | Humphries | 57/217 |
| 3,778,994 | 12/1973 | Humphries | 57/217 |
| 3,922,437 | 11/1975 | Kitta et al. | 57/223 |
| 4,181,775 | 1/1980 | Corke | 428/348 |
| 4,464,425 | 8/1984 | Voight et al. | 428/36 |
| 4,468,435 | 8/1984 | Shinibu et al. | 428/383 |
| 4,521,470 | 6/1985 | Overbergh et al. | 428/212 |

*Primary Examiner*—Paul J. Thibodeau

*Attorney, Agent, or Firm*—Sughrue, Mion, Zinn, Macpeak & Seas

[57] ABSTRACT

A prestressing steel material for use with concrete that is prestressed by posttensioning is disclosed. Said steel material is unbonded from the concrete. The prestressing steel material is composed of a steel member sheathed with a foamed synthetic resin tube. The wall thickness of the synthetic resin tube is at least 300 microns, more preferably, more than 500 microns. In the case that the steel member is a strand composed of a plurality of twisted steel wires, the spiral grooves of the strand are first filled with a resin and the strand together with the resin sheathed with the foamed synthetic resin tube.

7 Claims, 4 Drawing Figures

STEEL MATERIALS FOR USE WITH PRESTRESSED CONCRETE

BACKGROUND OF THE INVENTION

The present invention relates to prestressing steel materials for use with concrete that is prestressed by posttensioning. In particular, the present invention relates to a prestressing steel material subjected to the posttensioning to be in an unbonded state in which the steel material is not bonded to the concrete.

Concrete has a relatively low tensile strength. In order to overcome this disadvantage, prestressed concrete has been developed. By means of high strength steel wires, bars or strands, a concrete member is precompressed. When the structure receives a load, the compression is relieved on that portion which would normally be in tension.

There are two general methods of prestressing, namely, pretensioning and posttensioning. The present invention relates to prestressing steel materials for use with concrete of the type that is prestressed by posttensioning.

Structural designs used to prevent direct contact between prestressing steel materials and the surrounding prestressed concrete are illustrated in FIGS. 1 and 2. The design shown in FIG. 1 can be used whether the steel material is in the form of a wire, bar or strand. A steel member 1 having a grease coating 2 is sheathed with a PE (polyethylene) tube 3. When the steel member 1 with the PE tube 3 is placed within a concrete section 3, the lubricating effect of the intermediate grease coating 2 reduces the coefficient of friction between the steel member and concrete to as low as between 0.002 and 0.005 $m^{-1}$. Because of this low coefficient of friction, the design in FIG. 1 provides great ease in posttensioning a long steel cable in concrete. However, if the steel material is of short length, the need for preventing grease leakage from either end of the PE tube presents great difficulty in fabricating and handling the steel material. Furthermore, steel members having screws or heads at both ends are difficult to produce in a continuous fashion.

The steel member 1 shown in FIG. 2, which is encapsulated in asphalt 5, has a slightly greater coefficient of friction than the structure shown in FIG. 1. This design is extensively used with relatively short steel materials since it is simple in construction, is leak-free, and provides ease in unbonding the steel material from the concrete, even if the steel member has screws or heads at end portions.

One problem with the design in FIG. 2 is that the presence of the asphalt (or, alternatively, a paint) may adversely affect the working environment due to the inclusion therein of a volatile organic solvent. Moreover, the floor may be fouled by the splashing of the asphalt or paint. As another problem, great difficulty is involved in handling the coated steel material during drying or positioning within a framework, and separation of the asphalt coating can easily occur unless utmost care is taken in ensuring the desired coating thickness.

SUMMARY OF THE INVENTION

Accordingly, a primary object of the present invention is to provide a prestressing steel material for use with prestressed concrete that is free from the problems associated with the prior art techniques. In particular, the present invention provides a prestressing steel material subject to the posttensioning to be in an unbonded state in which the steel material is not bonded to the concrete.

This and other objects of the present invention are achieved by sheathing a prestressing steel member with a foamed synthetic resin tube.

DESCRIPTION OF THE PREFERRED EMBODIMENTS

Figure 1:
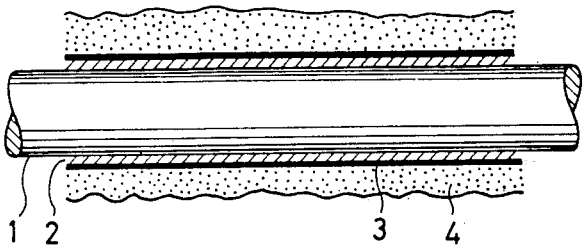
FIGS. 1 and 2 show schematically conventional designs of prestressing steel materials for concrete prestressed by posttensioning.
Figure 2:
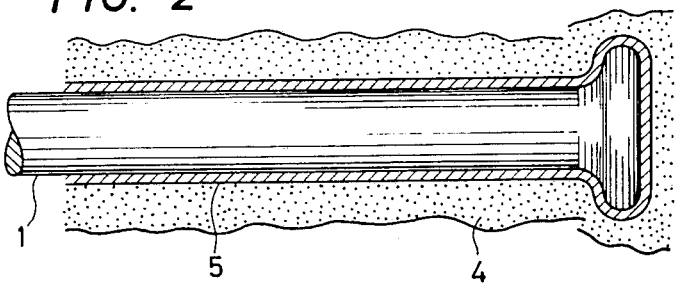
Figure 3:
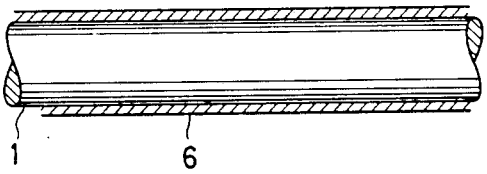
FIG. 3 is a schematic presentation of a prestressing steel material of the present invention for use with prestressed concrete.

FIG. 3 shows schematically an ungreased prestressing steel member 1, which, according to a preferred embodiment of the present invention, is sheathed with a foamed synthetic resin tube 6. Various methods may be used to cover the steel member 1 with the resin tube. In one method, a synthetic resin powder containing a blowing agent is applied to provide a foamed coating on the surface of a preheated steel member by a fluidized dip coating or electrostatic coating technique. Alternatively, a film of synthetic resin containing a blowing agent is formed on the surface of the steel member 1, which is then passed through a heating chamber to expand the resin film into a foam. If desired, a preliminarily formed synthetic resin foam tube 6 may be slipped over the steel member 1. The resin tube 6 may or may to be bonded to the steel member 1.

In order to isolate the prestressing steel material 1 sufficiently from concrete to facilitate the subsequent posttensioning, the foamed synthetic resin tube 6 must have a wall thickness of at least 300 microns. Furthermore, in order to reduce the frictional resistance and therefore the slippage between the steel member 1 and the concrete, the resin tube 6 preferably has a wall thickness of at least 500 microns.

Steel bars, one example of a prestressing steel member according to the present invention, were sheathed with a foamed polyethylene tube. The tube was prepared from a blowing agent loaded polyethylene powder that was applied to preheated steel bars using a fluidized dip coating technique. The properties of these samples were as shown in Tables 1 and 2:

TABLE 1

| Basic Properties of Steel Bars | |
|---|---|
| Bar dimensions: | 17 $mm^{\Phi}$ × 2,830 $mm^{L}$ |
| Polyethylene tube: | prepared from medium-density PE powder (density: 0.925 g/$cm^3$, m.p. 120° C.) containing 1.0% heat-decomposable blowing agent |
| Wall thickness of polyethylene tube: | 1.3–1.5 mm |
| Occluded cells: | Open cells of a size of 0.3–0.5 mm distributed uniformity in a thickness of 3–4 microns |

TABLE 2

| Sample No. | Unbonding (Frictional) Properties: Load (Kgf) Tensioned side (Pi) | Fixed side (Po) | Frictional loss (Kgf) | Frictional coefficient $\lambda$ ($m^{-1}$) | Remarks |
|---|---|---|---|---|---|
| 1 | 19.510 | 19.140 | 370 | 0.0079 | Length of concrete section: l = 2,435 mm Sample temperature: T = 25° C. Frictional coefficient: $\lambda = \left(\frac{Pi}{Po} - 1\right) \cdot \frac{1}{l}$ |
| 2 | 19.540 | 19.200 | 340 | 0.0073 | |
| 3 | 19.500 | 19.010 | 490 | 0.0106 | |
| 4 | 19.480 | 19.040 | 440 | 0.0095 | |
| 5 | 19.510 | 19.115 | 395 | 0.0085 | |
| 6 | 19.530 | 19.170 | 360 | 0.0077 | |
| 7 | 19.500 | 19.040 | 455 | 0.0098 | |
| 8 | 19.510 | 18.965 | 545 | 0.0118 | |
| 9 | 19.500 | 19.220 | 280 | 0.0060 | |
| 10 | 19.490 | 19.125 | 365 | 0.0078 | |

TABLE 3

| Sample | Resin coat Thickness (microns) | Surface features | Result |
|---|---|---|---|
| Barax (unbonded) | 300–500 | unscratched | No rust formed even after 2,000 hrs |
| Barax (unbonded) | 300–500 | scratched | Severe rust formed around scratches after 200 hrs |
| Foamed polyethylene coating | 300–500 | unscratched | No rust formed even after 2,000 hrs |
| Foamed polyethylene coating | 300–500 | scratched | Rust formed only at scratches after 500 hrs |

Figure 4:
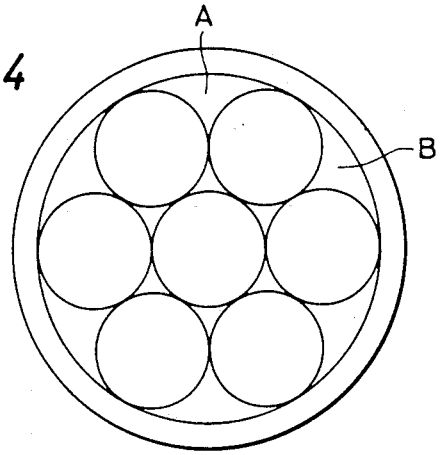
FIG. 4 shows a cross section of a prestressing steel strand sheathed with a foamed resin tube according to the present invention.

The present invention is also applicable to a steel strand composed of a plurality of twisted prestressing steel wires as shown in FIG. 4. The resulting steel strand has spiral grooves as indicated by A and B in FIG. 4. Not only do these grooves render the posttensioning of the strand difficult, but they also increase the frictional resistance on the stressed concrete. In order to avoid these problems, the grooves are filled with a resin. Such filling with a resin may be accomplished by extrusion or other suitable techniques. Subsequently, the thus-treated steel strand is sheathed with the foamed synthetic resin tube as above.

According to the present invention, a prestressing steel material for use with prestressed concrete can be easily manufactured. The resulting steel material is easy to handle during transportation and installation.

We claim:

1. An elongated prestressing steel material embedded in prestressed concrete, comprising: an elongated ungreased steel member, and a foamed synthetic resin tube sheathing bonded to said steel member and not bonded to said concrete.

2. The prestressing steel material of claim 1, wherein a wall thickness of said tube is at least 300 microns.

3. The prestressing steel material of claim 1, wherein a wall thickness of said tube is at least 500 microns.

4. The prestressing steel material of claim 1, wherein said synthetic resin is a foamed polyethylene tube.

5. The prestressing steel material of claim 1, wherein said synthetic resin tube is formed by applying a synthetic resin powder containing a blowing agent to a surface of a preheated steel member.

6. The prestressing steel material of claim 1, wherein said synthetic resin tube is formed by applying a film of synthetic resin containing a blowing agent to a surface of said steel member and then heating said steel member to expand said resin into a foam.

7. An elongated ungreased prestressing steel material embedded in prestressed concrete, comprising: a steel strand having a plurality of twisted steel wires, said steel strand having a plurality of spiral grooves formed therein; a resin filling said grooves; and a foamed synthetic resin tube sheathing bonded to said strand and not bonded to said concrete.

* * * * *